US009711862B2

(12) United States Patent
Fujita et al.

(10) Patent No.: US 9,711,862 B2
(45) Date of Patent: Jul. 18, 2017

(54) WIRELESS DEVICE AND WIRELESS SYSTEM

(71) Applicant: Panasonic Intellectual Property Management Co., Ltd., Osaka (JP)

(72) Inventors: Suguru Fujita, Tokyo (JP); Maki Nakamura, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 5 days.

(21) Appl. No.: 14/723,133

(22) Filed: May 27, 2015

(65) Prior Publication Data

US 2015/0357701 A1 Dec. 10, 2015

(30) Foreign Application Priority Data

Jun. 4, 2014 (JP) ..... 2014-116110

(51) Int. Cl.
*H01Q 15/02* (2006.01)

(52) U.S. Cl.
CPC ..... *H01Q 15/02* (2013.01)

(58) Field of Classification Search
CPC ..... H01Q 1/2283; H01Q 15/02
See application file for complete search history.

(56) References Cited

U.S. PATENT DOCUMENTS 5,955,752 A * 9/1999 Fukaya ..... G01S 7/032 257/275
6,496,138 B1 * 12/2002 Honma ..... G01S 13/931 342/27
2010/0039339 A1 2/2010 Kuroda et al.
2011/0140984 A1 6/2011 Suematsu et al.
2014/0110840 A1 * 4/2014 Wojnowski ..... H01L 23/49822 257/738

FOREIGN PATENT DOCUMENTS

JP 2011-124790 6/2011
WO 2006/046432 5/2006
WO 2007/141850 12/2007

* cited by examiner

*Primary Examiner* — Robert Karacsony
(74) *Attorney, Agent, or Firm* — Seed IP Law Group LLP

(57) ABSTRACT

A wireless device includes an antenna that has a planar shape and radiates a radio signal toward another wireless device, and a chassis housing the antenna and having an outer peripheral portion placed to face the antenna. Multiple distances between a surface of the outer peripheral portion and the antenna are non-uniform.

9 Claims, 13 Drawing Sheets

WIRELESS DEVICE AND WIRELESS SYSTEM

BACKGROUND

1. Technical Field

The present disclosure relates to a wireless device and a wireless system for transmitting radio signals.

2. Description of the Related Art

Wireless systems that transmit radio signals between wireless devices conventionally are known.

A known wireless system includes a first wireless device and a second wireless device facing the first wireless device (Japanese Patent No. 4556951, for example). The first wireless device includes a planar transmitting antenna. The second wireless device includes a planar receiving antenna that receives a main beam sent from the transmitting antenna. In this wireless system, a planar direction of the receiving antenna or a planar direction of the transmitting antenna is inclined with respect to an axis of the main beam. With this configuration, an error signal does not reach the receiving surface of the receiving antenna. The error signal traveling toward the receiving antenna is formed of a main beam that has been reflected by the receiving antenna and the transmitting antenna.

SUMMARY

In the wireless system described in Japanese Patent No. 4556951, the reflected signal may interfere with a communication signal, and thus the wireless system has deteriorated communication properties.

A non-limiting and exemplary embodiment of the present disclosure provides a wireless device and a wireless system in which interference of the reflected signal with the communication signal is reduced to provide improved communication properties.

In one general aspect, the techniques disclosed here feature a wireless device including an antenna that has a planar shape and radiates a radio signal toward another wireless device, and a chassis housing the antenna and having an outer peripheral portion placed to face the antenna. Multiple distances between a surface of the outer peripheral portion and the antenna are non-uniform.

According to the present disclosure, the interference of the reflected signal with the communication signal is reduced, and the communication properties are improved.

Additional benefits and advantages of the disclosed embodiments will become apparent from the specification and drawings. The benefits and/or advantages may be individually realized by the various embodiments and features of the specification and drawings, which need not all be provided in order to realize one or more such benefits and/or advantages.

DETAILED DESCRIPTION

Embodiments of the present disclosure are described with reference to the drawings.

Underlying Knowledge Forming Basis of Present Disclosure

In a wireless system, a wireless module that is mounted on a printed circuit board of a wireless device on a sending side transmits a radio wave, and a wireless module that is mounted on a printed circuit board of a wireless device on a receiving side receives the radio wave, for example.

When the wireless device on the sending side and the wireless device on the receiving side are placed to face each other, the radio wave transmitted from the wireless module on the sending side may be reflected by the printed circuit board of the wireless module on the receiving side and returned to the wireless device on the sending side. In such a case, the reflected radio wave superposes a transmission wave. The radio wave may also be reflected by the wireless device on the sending side, and the wireless device on the receiving side may receive a multiply reflected radio wave. As a result, communication properties (receiving properties) are deteriorated.

With the technique disclosed in Japanese Patent No. 4556951, the radio wave reflected by the antenna of the second wireless device is prevented from reaching the antenna of the first wireless device. However, the radio wave reflected by a surface of a chassis of the second wireless is not taken into account. The radio wave reflected by the surface of the chassis of the second wireless device may travel toward the antenna of the first wireless device. In such a case, the reflected signal may superpose a signal (communication signal) to be transmitted or received, deteriorating the communication properties.

The following embodiments describe a wireless device and a wireless system in which interference of the reflected signal with the communication signal is reduced to improve communication properties.

The wireless device in the embodiments of the present disclosure is a wireless unit including a chassis, for example, and is applicable to a wireless system that transmits a radio signal of a microwave including a millimeter wave.

First Embodiment

Figure 1:
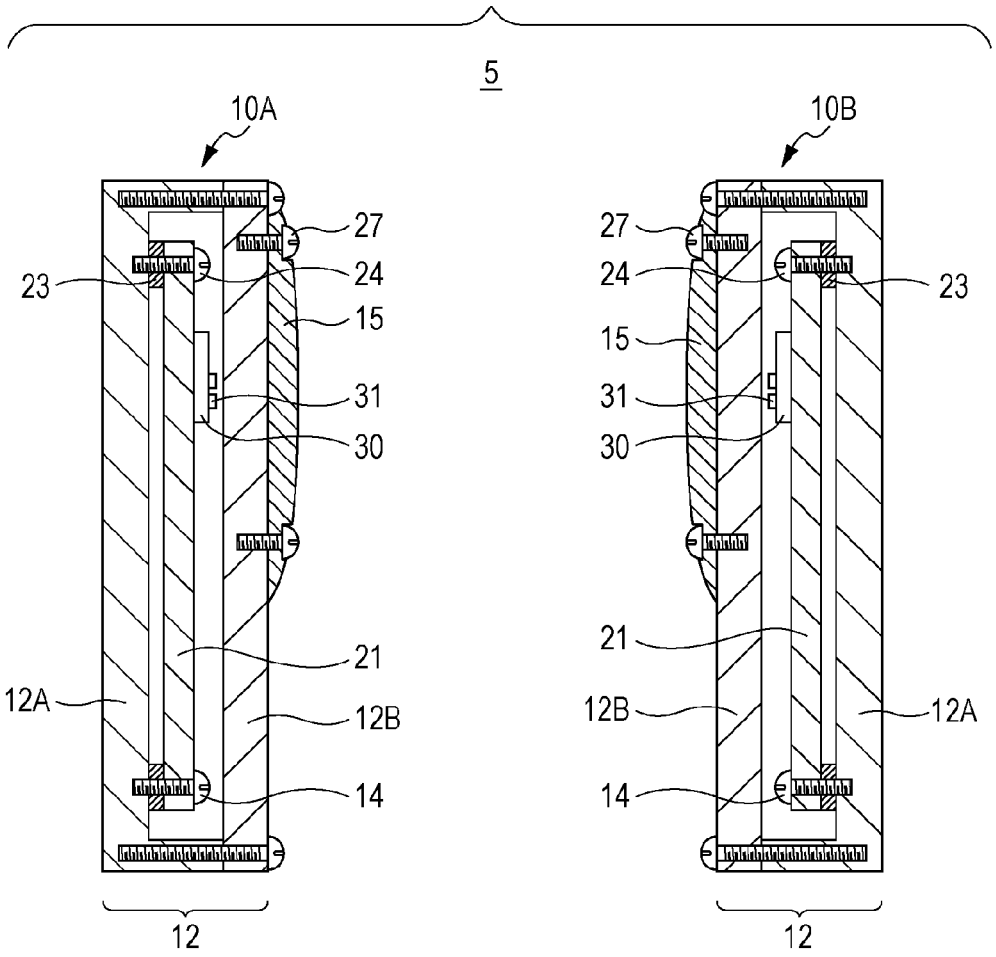
FIG. 1 illustrates a configuration example of a wireless system in a first embodiment.

FIG. 1 illustrates a configuration example of a wireless system 5 in a first embodiment. The wireless system 5 includes two wireless units 10 facing each other. The wireless units facing each other are fixed stations, for example. However, the wireless units may be mobile stations facing each other.

The wireless units 10 may be referred to as wireless units 10A and 10B when it is required to clarify whether the wireless unit is for transmitting or receiving. Similarly, "A" and "B" may be added to the reference numerals of the other components of the wireless units 10 to clarify whether the components are for transmitting or receiving.

Figure 2A:
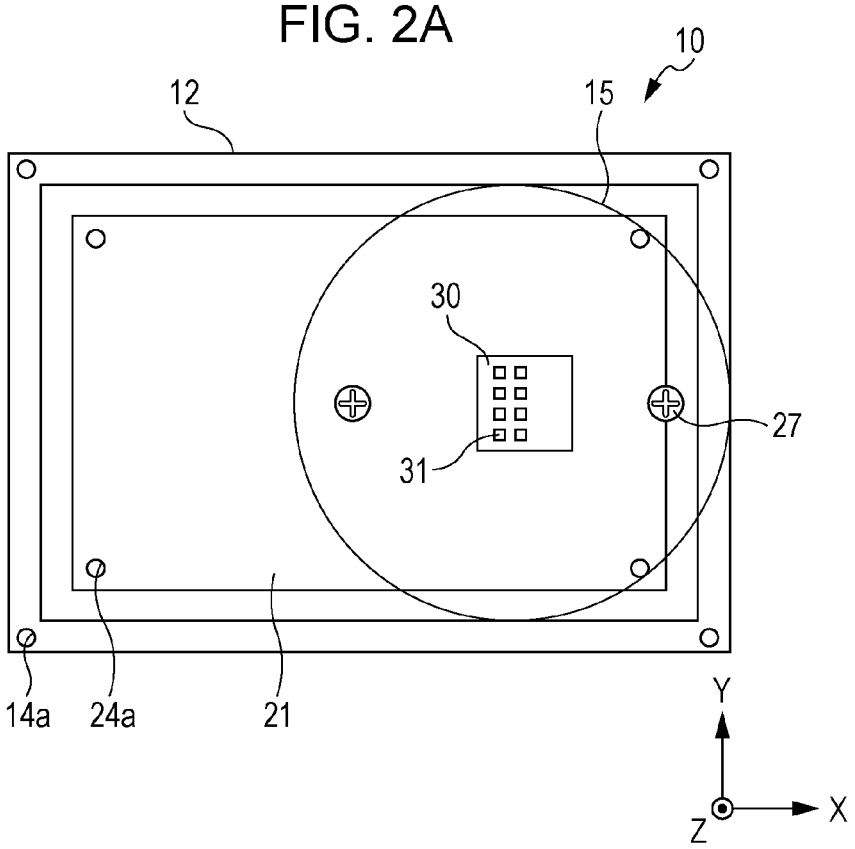
FIG. 2A is a transparent top view illustrating a configuration example of a wireless unit in the first embodiment.
Figure 2B:
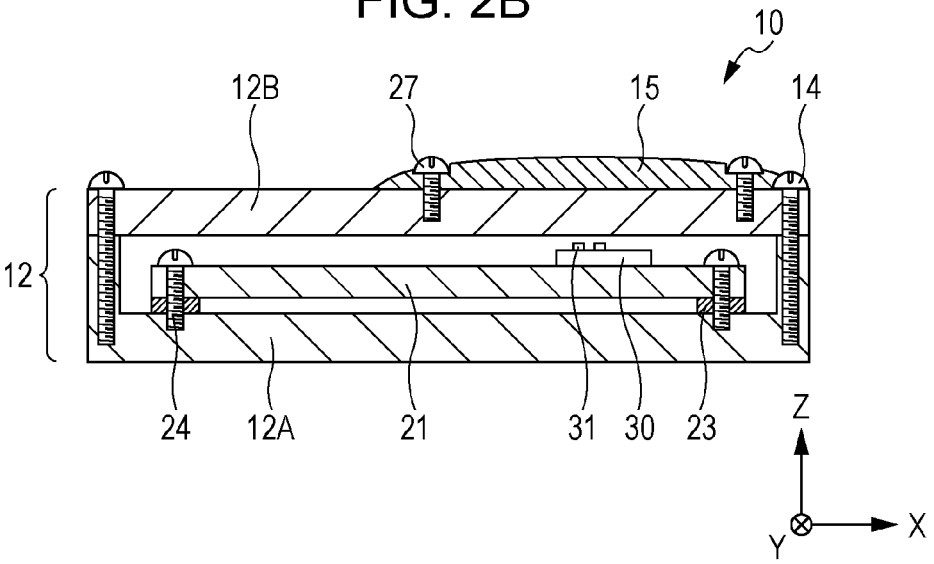
FIG. 2B is a cross-sectional side view illustrating a constructional example of the wireless unit in the first embodiment.

FIG. 2A and FIG. 2B illustrate a configuration example of the wireless unit 10. FIG. 2A is a transparent top view illustrating the wireless unit 10 from the upper side (positive side in the Z direction). FIG. 2B is a cross-sectional side view illustrating a constructional example of the wireless unit 10.

A surface parallel to a plane surface of the wireless unit 10 may be referred to as an X-Y surface, and a long-side direction and a short-side direction of the wireless unit 10 may be referred to as an X direction and a Y direction, respectively. A direction perpendicular to the plane surface of the wireless unit 10, or a direction perpendicular to the X-Y surface, may be referred to as a Z direction.

The wireless unit 10 includes a chassis 12 that includes a frame body 12A, which houses a wireless unit board 21, and a lid 12B. The lid 12B is disposed on the frame body 12A such that the inside of the chassis 12 becomes a closed space. The lid 12B is fixed to the frame body 12A by screws 14, for example. The frame body 12A includes screw holes 14*a* for receiving the screws 14 at four corners thereof. The chassis 12 may be made of any weather-resistant material.

The wireless unit board 21 is fixed to the bottom surface of the frame body 12A by screws 24, for example, with spacers 23 disposed therebetween. The wireless unit board 21 includes screw holes 24*a* for receiving the screws 24 at four corners thereof. A wireless module 30 is mounted on a surface of the wireless unit board 21 that faces the lid 12B (front surface, or surface on the positive side in the Z direction). The wireless module 30 is configured to transmit radio signals (millimeter wave radio signals, for example). The wireless module 30 has narrow directivity in a direction perpendicular to the plane surface on which antenna elements 31 are mounted, for example. Eight antenna elements 31, for example, are mounted on a plane surface (front surface) of the wireless module 30 that faces the lid 12B. The number of antenna elements may be any value. The antenna elements 31 on the plane surface are an example of a planar antenna portion.

On a rear surface of the wireless module 30, an RFIC (Radio Frequency Integrated Circuit) (not illustrated) is mounted such that the RFIC faces the antenna elements 31 with the wireless module 30 disposed therebetween. At a position adjacent to the RFIC, a BBIC (BaseBand IC) (not illustrated) is mounted on the rear surface of the wireless module 30.

The chassis 12 includes a protrusion 15 that is placed to face the wireless module 30 with the lid 12B disposed therebetween. The protrusion 15 is fixed onto an outer surface of the lid 12B by screws 27, for example. The protrusion 15 is formed of the same material as the chassis 12, for example, and has a spherical shape having a predetermined curvature. A top portion of the protrusion 15 is located in a line extending through a central portion of the antenna elements 31 in a direction perpendicular to the plane surface (Z direction). The protrusion 15 is an example of an outer peripheral portion.

An outer surface of the protrusion 15, which is an example of an outer peripheral surface, is shaped in such a manner that the outer surface and the plane surface, on which the antenna elements 31 are mounted, do not have a constant distance therebetween. In other words, the distances between points on the outer peripheral surface and the antenna portion are non-uniform. The top portion of the outer peripheral surface of the chassis 12 is farthest from the antenna elements 31.

Figure 3A:
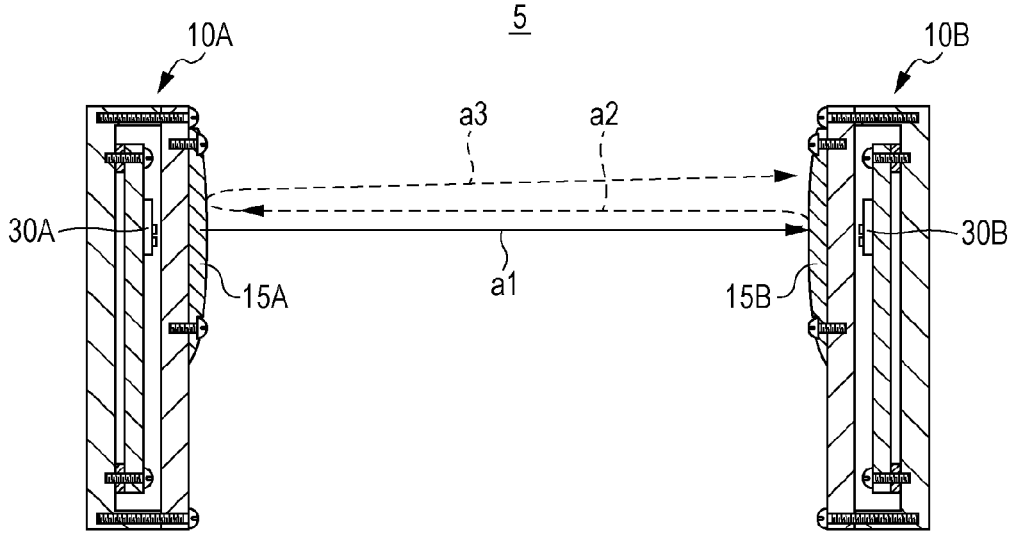
FIG. 3A illustrates an example of how a radio signal is transmitted or received in the wireless system of the first embodiment.

An example of radio signal communication in the wireless system 5, which includes the wireless units 10 facing each other, is described. FIG. 3A illustrates an example of how radio signals are transmitted and received in the wireless system 5.

The wireless module 30A of the wireless unit 10A transmits a transmission signal a1 to the wireless unit 10B, and the transmission signal a1 that reaches the wireless unit 10B is partly reflected by a surface of the protrusion 15B. A signal a2 that has been reflected by the protrusion 15B travels toward the wireless unit 10A at an inclination angle corresponding to the curvature of the protrusion 15B.

The signal a2 that reaches the wireless unit 10A is partly reflected by the surface of the protrusion 15A. A signal a3 that has been reflected by the protrusion 15A is returned toward the wireless unit 10B at an inclination angle corresponding to the curvature of the protrusion 15A.

As described above, since the direction of the transmission signal a1 is altered by the protrusions 15A and 15B, the reflected signal generated from the transmission signal does not reach the receiving region of the antenna elements 31 mounted on the wireless module 30B of the wireless unit 10B. Thus, the wireless unit 10B is unlikely to receive the reflected signal (signal a3, for example), and thus the reflected signal is unlikely to become an interfering wave. A reflected signal reflected multiple times may also not reach the receiving region of the wireless module 30B.

Next, the curvature of the protrusion 15 of the wireless unit 10 is discussed.

The distance between the wireless unit 10A and the wireless unit 10B is represented by L, and a curvature of the protrusion 15 of the chassis 12 included in each of the wireless units 10A and 10B is represented by 1/r. When a radio wave transmitted from the antenna portion of the wireless unit 10A at an angle α is reflected by the protrusion 15B of the chassis 12 of the wireless unit 10B and returned to the wireless unit 10A, the distance between the antenna portion of the wireless unit 10A and a point of arrival a of the reflected radio wave satisfy the following equation 1.

$$a=\tan(\alpha+2\beta)\cdot A+A\cdot\tan\alpha \quad \text{(Equation 1)}$$

The symbol A in the equation 1 has a smaller absolute value of two solutions of X in the following equation 2.

$$\{(\tan\alpha)^2+1\}X^2+\{2(2r+1)\cdot\tan\alpha\}X+(3r^2+4rL+L^2) \quad \text{(Equation 2)}$$

The symbol β in the equation 1 is represented by the following equation 3.

$$\beta=\arctan\{A(\tan\alpha)/(2r+L-A)\} \quad \text{(Equation 3)}$$

As can be seen from the above, the larger the curvature of the protrusion 15, the smaller the influence of the reflected signal.

Figure 3B:
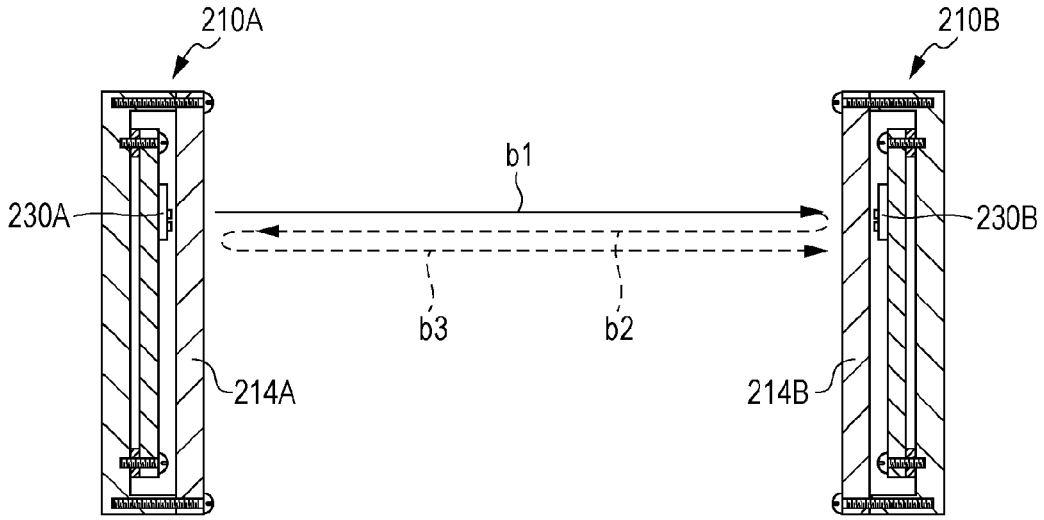
FIG. 3B illustrates how a radio signal is transmitted or received in a wireless system of a comparative example.

FIG. 3B illustrates a comparative example that includes wireless units 210A and 210B not having the protrusions 15, which are included in the wireless units 10.

A transmission signal b1 transmitted to the wireless unit 210B is partly reflected by the surface of a lid 214B when reaching the wireless unit 210B. A signal b2 that has been reflected by the lid 214B reflects 180 degrees and travels to the wireless unit 210A.

The signal b2 traveling to the wireless unit 210A is partly reflected by a surface of a lid 214A. A signal b3 that has been reflected by the surface of the lid 214A reflects 180 degrees and is returned to the wireless unit 210B.

The reflected signal b3 superposes the transmission signal b1, and then the wireless module 230B of the wireless unit 210B receives the superposed signal. As a result, the reflected signal b3 is an interfering wave and causes interference with the communication. In the comparative example, the reflected signal (signal b3) interferes with the communication signal (transmission signal b1), and communication properties between the wireless units 210A and 210B are deteriorated.

In the present embodiment, the direction of the signal reflected by the protrusion 15B of the wireless unit 10B on the receiving side is changed depending on the curvature of the protrusion 15B. In addition, since the reflected signal is further reflected by the protrusion 15A of the wireless unit 10A on the sending side, the direction of the reflected signal is changed depending on the curvature of the protrusion 15A. Thus, the wireless unit 10B on the receiving side is unlikely to receive the multiply reflected signal. With this configuration, communication is unlikely to be influenced by the signal reflected between the wireless units 10A and 10B. As a result, the communication properties are improved.

In addition, when the protrusion 15 has the top portion at a position corresponding to the central portion of the antenna elements 31, the reflected signals traveling to the antenna elements 31 are efficiently distributed. In this configuration, since the protrusion 15 has a highly symmetrical structure, transmission signal properties are also improved. As a result, deterioration in the communication properties is further reduced.

Second Embodiment

In a second embodiment, a protrusion has a curvature that is larger than that in the first embodiment.

A wireless unit in the second embodiment has substantially the same configuration as the wireless unit in the first embodiment. The same components as those in the first embodiment are assigned the same reference numerals as those in the first embodiment, and an explanation thereof is omitted.

Figure 4A:
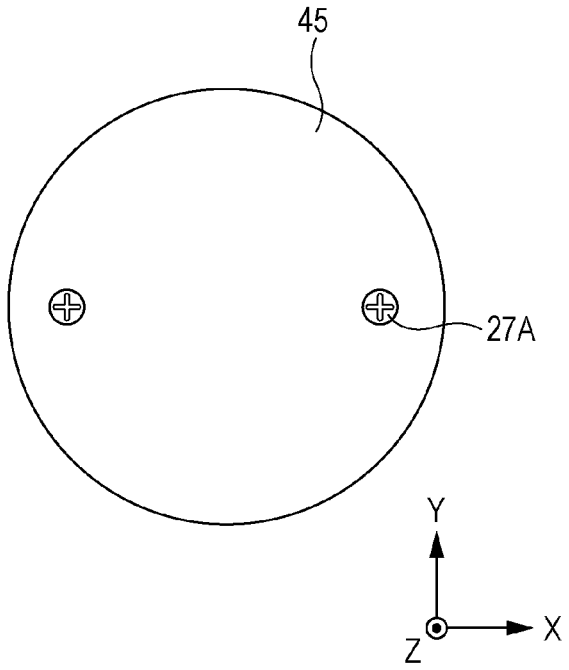
FIG. 4A is a top plan view of a protrusion and illustrates a configuration example of a wireless unit in a second embodiment.
Figure 4B:
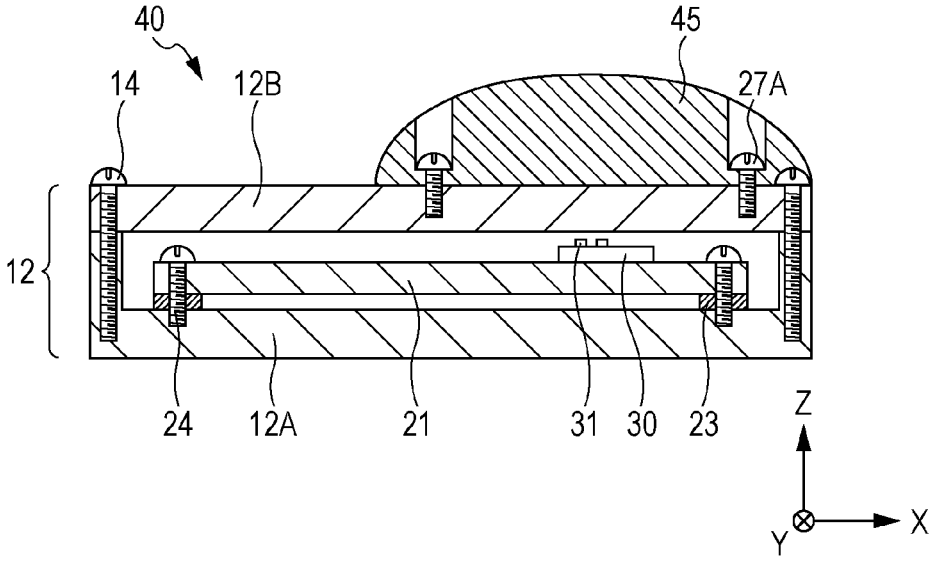
FIG. 4B is a cross-sectional side view illustrating a constructional example of a wireless unit in the second embodiment.

FIG. 4A and FIG. 4B illustrate a configuration example of a wireless unit 40 of the second embodiment. FIG. 4A is a top plan view of a protrusion 45. FIG. 4B is a cross-sectional side view illustrating a constructional example of the wireless unit 40.

As in the first embodiment, the protrusion 45 faces the wireless module 30 with the lid 12B disposed therebetween. The protrusion 45 is fixed onto the outer surface of the lid 12B by screws 27A, for example. The protrusion 45 is, for example, formed of the same material as the chassis 12, and has a spherical shape. The protrusion 45 has a larger curvature than the protrusion 15 of the first embodiment at a portion including the top portion.

The top portion of the protrusion 45 is aligned with the central portion of the antenna elements 31 in a direction perpendicular to the plane surface (Z direction).

As described above, the protrusion 45 has a larger curvature. With this configuration, even when the wireless units 40A and 40B are located close to each other, the protrusion 45 can reflect the signal from the other one of the wireless units 40 at a large angle. As a result, the reflected signal is unlikely to interfere with the transmission signal transmitted from the wireless unit 40.

The protrusion 45 is designed to have a proper curvature depending on the distance to the other one of the wireless units 40 such that the reflected signal does not become an interfering wave. In addition, since the protrusion 45 is fixed to the lid 12B by screws, the protrusion 45 is readily replaced with another protrusion having a different curvature. The same is applicable to the first embodiment.

Third Embodiment

A protrusion in a third embodiment has a different shape to protrusions in the first and second embodiments.

A wireless unit in the third embodiment has substantially the same configuration as the wireless unit in the first embodiment. The same components as those in the first embodiment are assigned the same reference numerals as those in the first embodiment, and an explanation thereof is omitted.

Figure 5A:
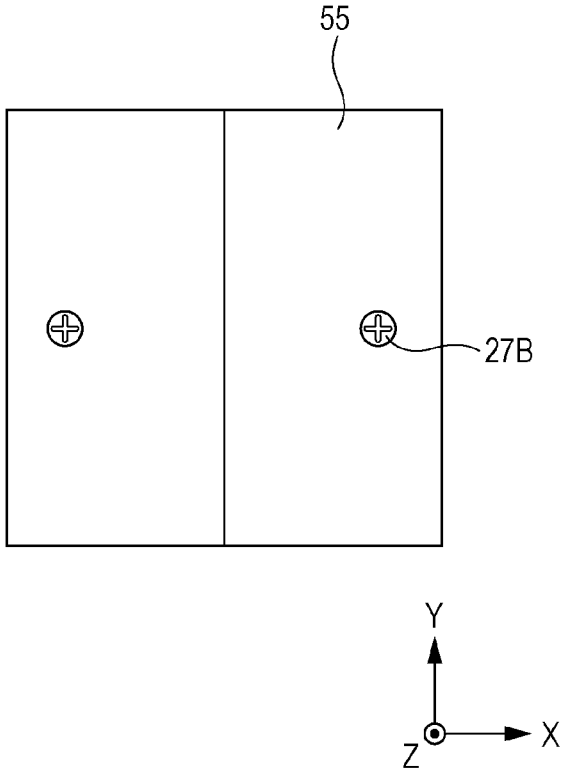
FIG. 5A is a top plan view of a protrusion and illustrates a configuration example of a wireless unit in a third embodiment.
Figure 5B:
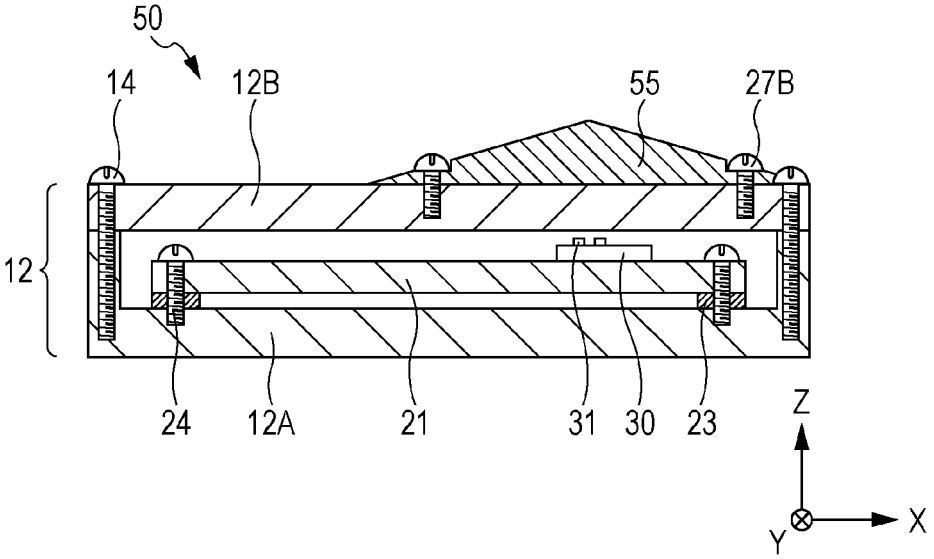
FIG. 5B is a cross-sectional side view illustrating a constructional example of a wireless unit in the third embodiment.

FIGS. 5A and 5B illustrate a configuration example of a wireless unit 50 of the third embodiment. FIG. 5A is a top plan view of a protrusion 55. FIG. 5B is a cross-sectional side view illustrating a constructional example of the wireless unit 50.

As in the first embodiment, the protrusion 55 faces the wireless module 30 with the lid 12B disposed therebetween. The protrusion 55 is fixed onto the outer surface of the lid 12B by screws 27B, for example. The protrusion 55 is formed of the same material as the chassis 12, for example, and has a triangular prism shape like a roof.

The top portion (top edge) of the protrusion 55, i.e., lateral edge of the triangular prism, which extends in the Y direction, and a center line, which extends through the center of the antenna elements 31 in the Y direction, are located at the same position in the X direction.

As described above, in the wireless unit 50, the protrusion 55 having a triangular prism shape also changes the angles of the signals reflected in two different directions. As a result, the interference between the transmission signal and the reflected signal is unlikely to be caused by the wireless unit 50. In addition, the protrusion 55 having a triangular prism shape is readily formed compared with the protrusion having a spherical shape.

Fourth Embodiment

In a fourth embodiment, the top edge is positioned further away in the X direction compared with that in the third embodiment.

A wireless unit in the fourth embodiment has substantially the same configuration as the wireless unit in the third embodiment. The same components as those in the third embodiment are assigned the same reference numerals as those in the third embodiment, and an explanation thereof is omitted.

Figure 6A:
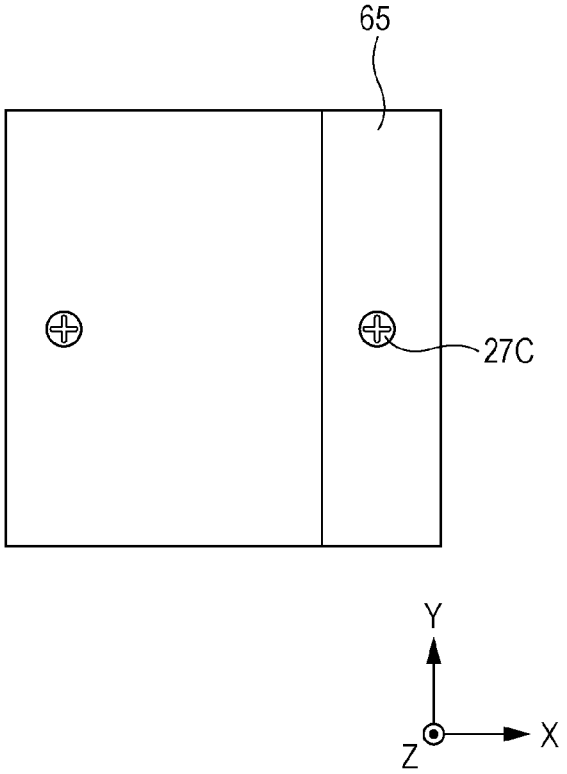
FIG. 6A is a top plan view of a protrusion and illustrates a configuration example of a wireless unit in a fourth embodiment.
Figure 6B:
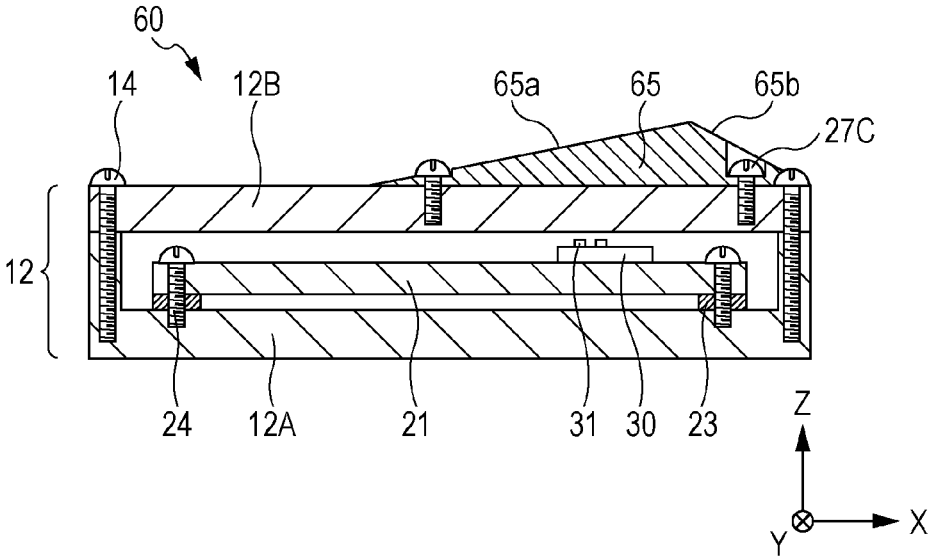
FIG. 6B is a cross-sectional side view illustrating a configuration example of a wireless unit in the fourth embodiment.

FIGS. 6A and 6B illustrate a configuration example of a wireless unit 60 in the fourth embodiment. FIG. 6A is a top plan view of a protrusion 65. FIG. 6B is a cross-sectional side view illustrating a constructional example of the wireless unit 60.

As in the third embodiment, the protrusion 65 faces the wireless module 30 with the lid 12B disposed therebetween. The protrusion 65 is fixed onto the outer surface of the lid 12B by screws 27C, for example. As in the third embodiment, the protrusion 65 has a triangular prism shape like a roof. However, the top portion (top edge) of the protrusion 65 extending in the Y direction, i.e., a lateral edge of the triangular prism, is positioned further away in the X direction toward the end portion. The top edge is not positioned directly above the antenna elements 31. The protrusion 65 includes an end slope surface 65*b* and a central slope surface 65*a* having a larger area than the end slope surface 65*b*. The transmission signals are reflected mainly by the central slope surface 65*a*, which faces the antenna elements 31 on the wireless module 30, such that the angle thereof is changed in such a way that the transmission signal travels in a direction away from the end slope surface 65. The end slope surface 65*b* of the protrusion 65 may have a larger area than the central slope surface 65*a*.

The signals may be blocked when reflected toward possible obstacles, e.g., a ceiling or outside buildings. In such a case, the protrusion 65 can reflect incoming signals in a different direction so as to be less influenced by the obstacles. With this configuration, the interference of the reflected signal with the communication signal is reduced under various circumstances. As a result, the communication properties of the wireless unit 60 are improved. The wireless unit 60 is used in a room, or on a railway platform, for example.

Fifth Embodiment

In a fifth embodiment, the protrusion is angled at 90 degrees in the X-Y plane compared with the position in the third embodiment.

A wireless unit in the fifth embodiment has substantially the same configuration as the wireless unit in the third embodiment. The same components as those in the third embodiment are assigned the same reference numerals as those in the third embodiment, and an explanation thereof is omitted.

Figure 7A:
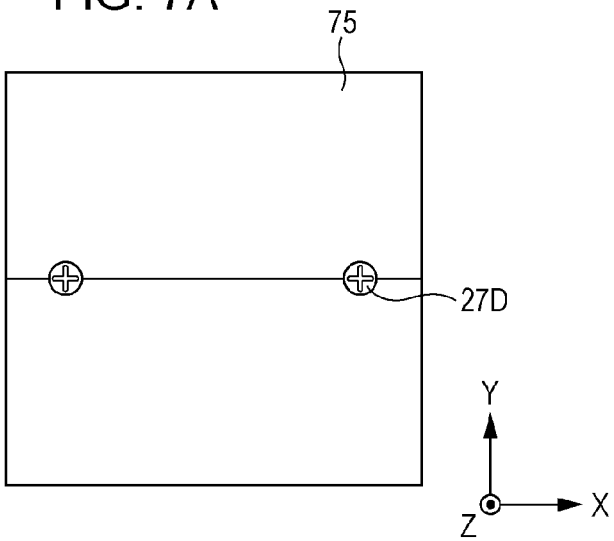
FIG. 7A is a top plan view of a protrusion and illustrates a configuration example of a wireless unit in a fifth embodiment.
Figure 7B:
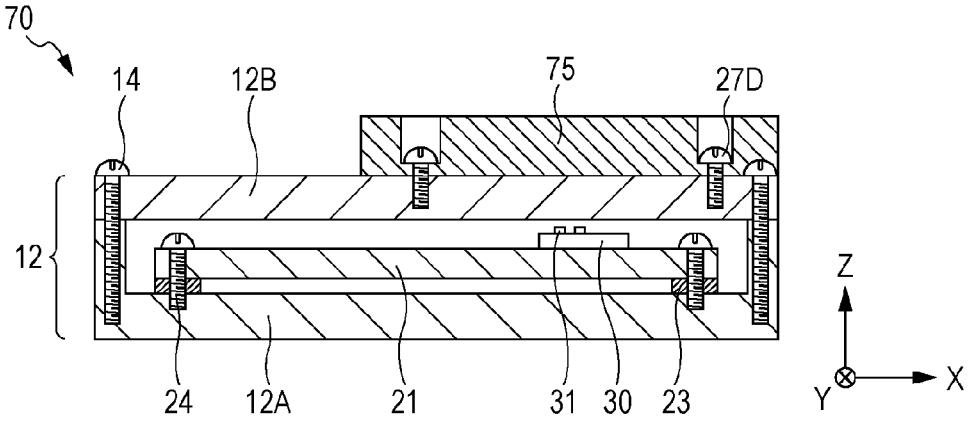
FIG. 7B is a cross-sectional side view viewed in the Y direction and illustrates a constructional example of the wireless unit in the fifth embodiment.
Figure 7C:
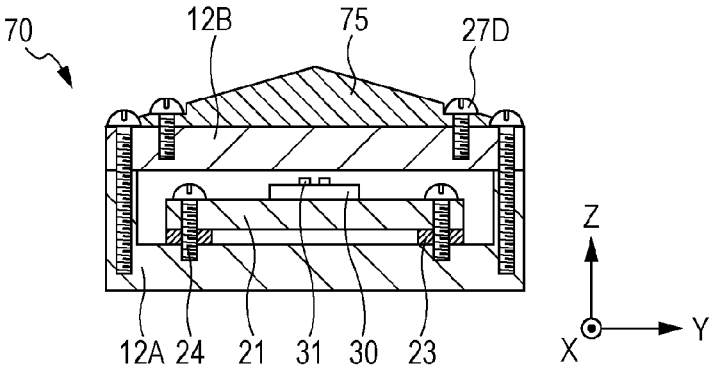
FIG. 7C is a cross-sectional side view viewed in the X direction and illustrates a constructional example of the wireless unit in the fifth embodiment.

FIG. 7A to FIG. 7C illustrate a configuration example of a wireless unit 70 of the fifth embodiment. FIG. 7A is a top plan view of a protrusion 75. FIG. 7B is a cross-sectional side view illustrating a constructional example of the wireless unit 70 viewed in the Y direction. FIG. 7C is a cross-sectional side view illustrating a constructional example of the wireless unit 70 viewed in the X direction.

As in the third embodiment, the protrusion 75 faces the wireless module 30 with the lid 12B disposed therebetween. The protrusion 75 is fixed onto the outer surface of the lid 12B by screws 27D, for example. The protrusion 75 is formed of the same material as the chassis 12 and has a triangular prism shape like a roof.

The top portion (top edge) of the protrusion 75 extending in the X direction, i.e., a lateral edge of the triangular prism, and the central line, which extends through the center of the antenna elements 31 in the X direction, are located at the corresponding position in the Y direction.

As described above, the protrusion 75 having the triangular prism shape also changes the angles of the reflected signals. As a result, interference between the reflected signal and the transmission signal is unlikely to be caused by the wireless unit 70. In addition, the protrusion 75 having the triangular prism shape is readily formed compared with a spherical protrusion.

As in the fourth embodiment, the top edge may not be positioned directly above the antenna elements 31. In such a case, one of the slope surfaces of the protrusion 75 has a larger area than the other one of the slope surfaces. The transmission signal is reflected by the slope surface, which faces the antenna elements 31 on the wireless module 30, such that the angle thereof is changed in such a way that the transmission signal travels away from the other one of the slope surfaces, for example.

The signals may be blocked when reflected toward possible obstacles, e.g., a ceiling or outside buildings. In such a case, the protrusion can reflect the signals in a different direction so as to be less influenced by the obstacles. With this configuration, interference of the reflected signal with the communication signal is reduced under various circumstances. As a result, the communication properties of the wireless unit 70 are improved.

Sixth Embodiment

In a sixth embodiment, a protrusion has a quadrangular pyramid shape.

Figure 8A:
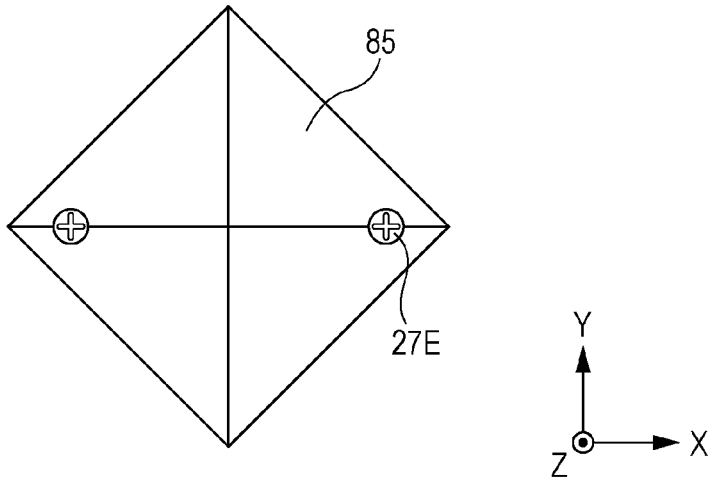
FIG. 8A is a top plan view of a protrusion and illustrates an example of the shape of the protrusion in a sixth embodiment.
Figure 8B:
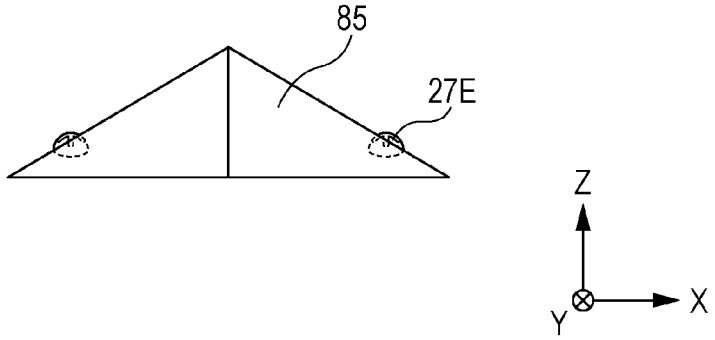
FIG. 8B is a side view of the protrusion viewed in the Y direction and illustrates an example of the shape of the protrusion in the sixth embodiment.

FIG. 8A and FIG. 8B illustrate an example of a shape of a protrusion 85 in the sixth embodiment. FIG. 8A is a top plan view of the protrusion 85. FIG. 8B is a cross-sectional side view of the protrusion 85 viewed in the Y direction.

As in the first embodiment, the protrusion 85 faces the wireless module 30 with the lid 12B disposed therebetween. The protrusion 85 is fixed onto the outer surface of the lid 12B by screws 27E, for example. The protrusion 85 has a quadrangular pyramid shape like a roof. The apex of the protrusion 85 is located at the position corresponding to the center of the antenna elements 31 in the X direction and the Y direction, for example. The apex of the protrusion is an example of a top portion.

The protrusion 85 having the quadrangular pyramid shape also can reflect the signal from the other one of the wireless units at an angle. The protrusion having the triangular prism shape, which has been described above, can reflect the signals in two directions, and the protrusion 85 having the quadrangular pyramid shape can reflect the signals in four directions. The reflected signal can be dispersed in multiple directions.

The apex of the protrusion 85 may be positioned away from the position corresponding to the center of the antenna elements 31. With this configuration, the protrusion 85 can reflect the signal in predetermined directions. As a result, the communication properties are improved.

Although the quadrangular pyramid has been described as an example of a polyangular pyramid, any pyramid such as a pentagonal pyramid, or a hexagonal pyramid may be employed as a shape of the protrusion 85.

Seventh Embodiment

In a seventh embodiment, the protrusion is angled at 45 degrees in the X-Y plane compared with the position in the sixth embodiment.

Figure 9A:
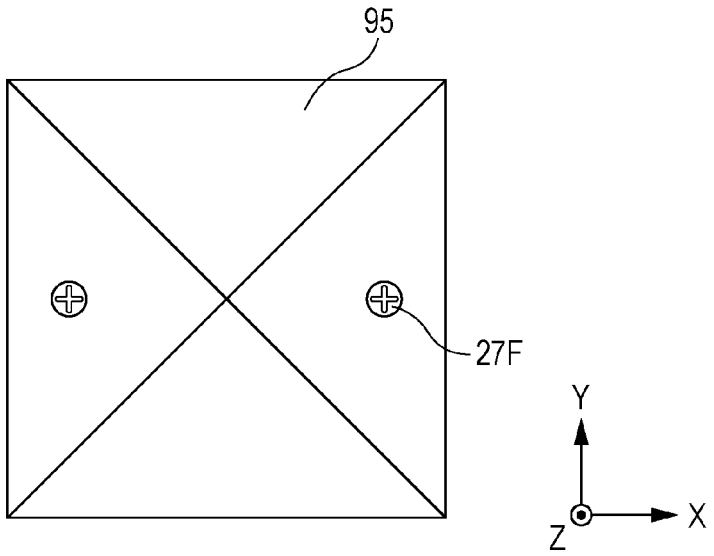
FIG. 9A is a top plan view of a protrusion and illustrates an example of the shape of the protrusion in a seventh embodiment.
Figure 9B:
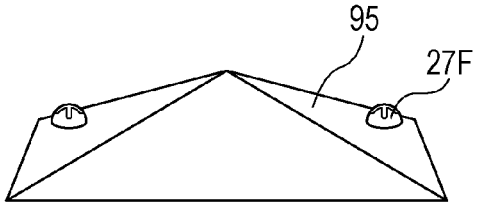
FIG. 9B is a perspective view viewed downwardly in the Y direction from an upper side (positive side in Z direction) and illustrates the example of the shape of the protrusion in the seventh embodiment.

FIG. 9A and FIG. 9B illustrate an example of a shape of a protrusion 95 in the seventh embodiment. FIG. 9A is a top plan view of the protrusion 95. FIG. 9B is a perspective view illustrating the shape of the protrusion 95 viewed downwardly from the upper side (positive side in the Z direction) in the Y direction.

The wireless unit in the seventh embodiment can have the same advantages as the sixth embodiment. The protrusion 95 in this embodiment reflects the signal that has reached the wireless unit in four directions that are different from the four directions in the sixth embodiment by 45 degrees.

Eighth Embodiment

In an eighth embodiment, a plate portion is used instead of the protrusion.

A wireless unit in the eighth embodiment has substantially the same configuration as the wireless unit in the first embodiment. The same components as those in the first embodiment are assigned the same reference numerals as those in the first embodiment, and an explanation thereof is omitted.

Figure 10A:
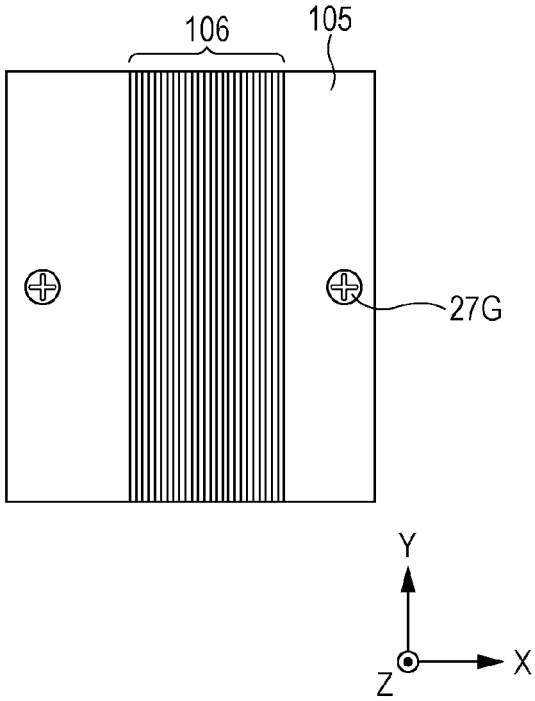
FIG. 10A is a top plan view of a plate portion and illustrates a configuration example of a wireless unit in an eighth embodiment.
Figure 10B:
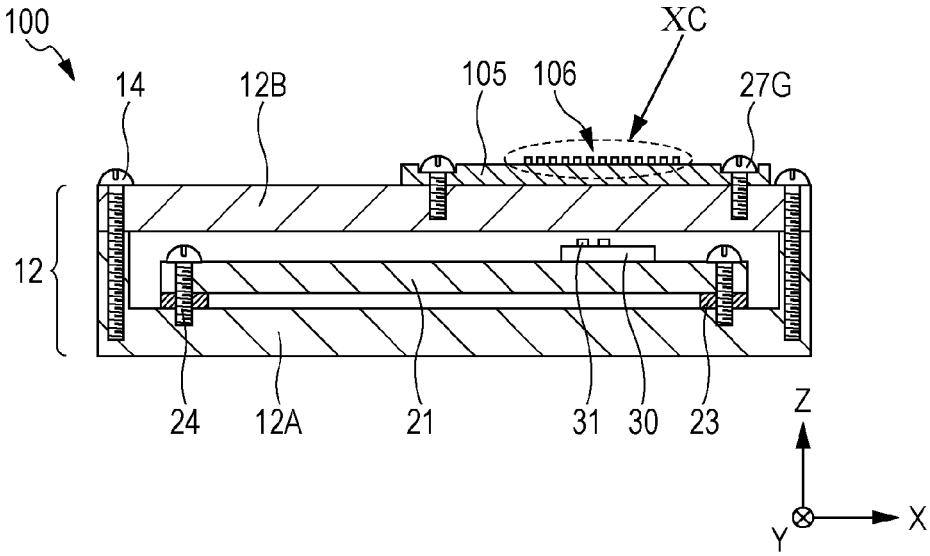
FIG. 10B is a cross-sectional side view viewed in the Y direction and illustrates a constructional example of the wireless unit in the eighth embodiment.
Figure 10C:
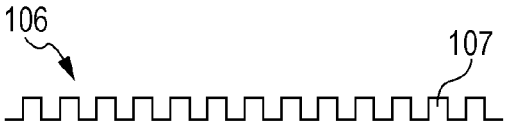
FIG. 10C is an enlarged view of a wavy section illustrated in FIG. 10B and illustrates a configuration example of the wireless unit in the eighth embodiment.

FIG. 10A to FIG. 10C are schematic views illustrating a configuration example of a wireless unit 100 in the eighth embodiment. FIG. 10A is a top plan view of the plate portion 105. FIG. 10B is a cross-sectional side view illustrating the constructional example of the wireless unit 100 viewed in the Y direction.

The plate portion 105 has a plate shape, for example. The plate portion 105 is fixed to the lid 12B by screws 27G, for example. An outer surface of the plate portion 105 includes a wavy section 106 at a position overlapping the wireless module 30 in the Z direction.

FIG. 10C is an enlarged view of a part of the wavy section 106, which is encircled by a broken line XC in FIG. 10B. The wavy section 106 includes a plurality of projections 107 each extending in a line in the Y direction. The projections 107 form concave portions and convex portions that are alternately arranged in the X direction. In other words, the wavy section 106 includes the projections 107 extending continuously in the Y direction. The projections 107 each have a rectangular cross-sectional shape, for example. The projection 107 is an example of the outer peripheral portion.

The projection 107 has a height that is determined depending on a path difference between the signals reflected by the plate portion 105. Specifically, the height of the projection 107 is determined depending on with a phase difference between the signal to be reflected by an upper surface of the projection 107 and the signal to be reflected by a groove (bottom surface) defined between adjacent projections 107. When the phase difference is 180 degrees, for example, the path difference is set at about $\lambda/4$ such that the signal traveling to the plate portion 105 and the signal traveling from (reflected by) the plate portion 105 cancel each other out. The symbol $\lambda$ represents a wavelength of the signal.

When the distance between the projections 107 (width of the concave portion) is too small, the signal is unlikely to enter the space between the projections 107. The distance between the projections 107 is set at about $\lambda/10$ or more, for example. With this configuration, the signal readily enters the space between the projections 107, and undesirable signals are likely to cancel each other out. The distance between the projections 107 and the width of each projection 107 (width of each convex portion) are substantially the same.

As described above, since the plate portion 105, which is used instead of the protrusion, includes the projections 107, components of the signal from the other one of the wireless units are canceled out at the plate portion 105. As a result, the other one of the wireless units has the improved receiving properties of the transmission signal.

Ninth Embodiment

In a ninth embodiment, the protrusion has a triangular cross-sectional shape instead of the rectangular cross-sectional shape in the eighth embodiment.

A wireless unit in the ninth embodiment has substantially the same configuration as the wireless unit in the eighth embodiment. The same components as those in the eighth embodiment are assigned the same reference numerals as those in the eighth embodiment, and an explanation thereof is omitted.

Figure 11A:
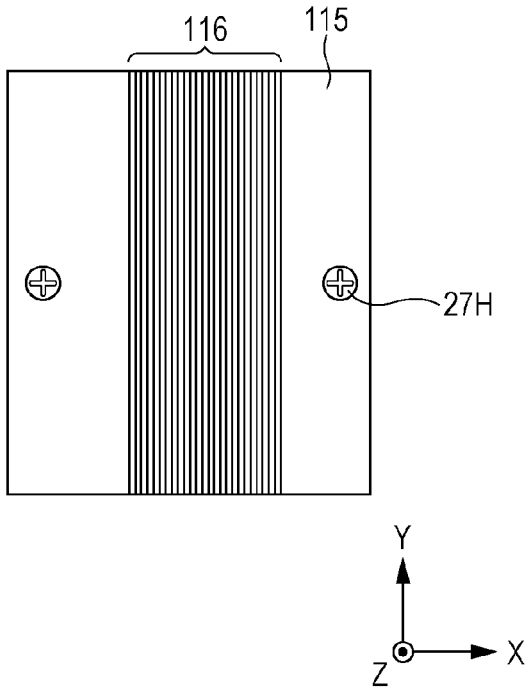
FIG. 11A is a top plan view of a plate portion and illustrates a configuration example of a wireless unit in a ninth embodiment.
Figure 11B:
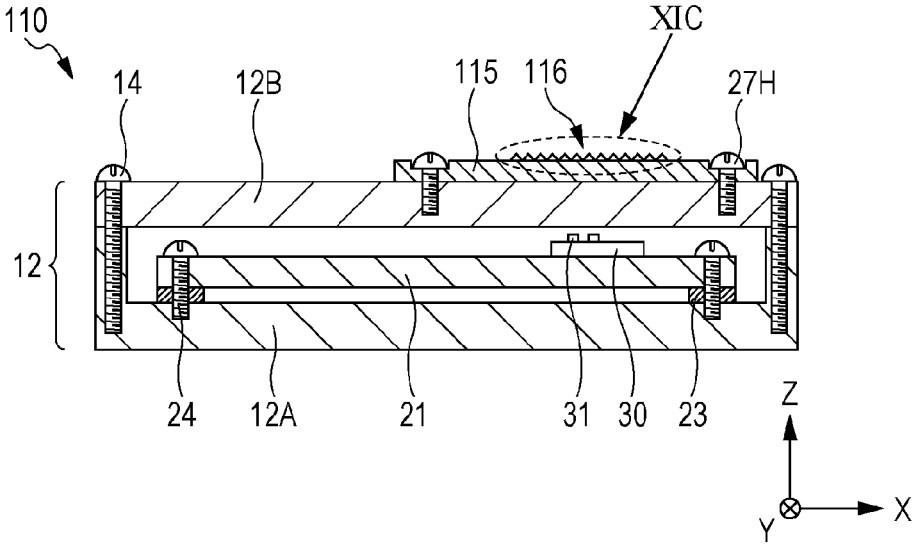
FIG. 11B is a cross-sectional side view viewed in the Y direction and illustrates the wireless unit in the ninth embodiment.
Figure 11C:
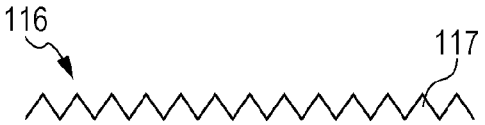
FIG. 11C is an enlarged view of a wavy section illustrated in FIG. 11B and illustrates a configuration example of a wireless unit in the ninth embodiment.

FIG. 11A to FIG. 11C illustrate a configuration example of a wireless unit 110 in the ninth embodiment. FIG. 11A is a top plan view of a plate portion 115. FIG. 11B is a cross-sectional side view illustrating the constructional example of the wireless unit 110 viewed in the Y direction.

The plate portion 115 has a plate-like shape. The plate portion 115 is fixed onto the lid 12B by screws 27H. An outer surface of the plate portion 115 includes a wavy section 116 at a position overlapping the wireless module 30 in the Z direction.

FIG. 11C is an enlarged view of the wavy section 116, which is encircled by a broken line XIC in FIG. 11B. The wavy section 116 includes projections 117 each extending in the Y direction and having a triangular cross-sectional shape. The projections 117 form V-shaped grooves and inverted V-shaped projections that are alternately arranged.

The signals traveling to the plate portion 115 (transmission signals from the other one of the wireless units 110) are reflected by slope surfaces of the projections 117 and the angles of the reflected signals are changed. The reflected signals travel in two different directions. In other words, the plate portion 115 does not reflect the incoming signals in the incoming direction.

When a distance between the projections 117, i.e., the width of the entrance to the V-shaped groove, is too small, the signal is unlikely to enter the space between the projections 117, i.e., V-shaped groove. The distance between the projections 117 is set at about λ/10 or more, for example.

As described above, since the plate portion 115, which is used instead of the protrusion, includes the projections 117, phases of the reflected signals are unlikely to be the same. In addition, the plate portion 115 can reflect the signals reaching the plate portion 115 at an angle. As a result, the signal reflected by the plate portion 115 are unlikely to interfere with the transmission signal transmitted from the wireless unit 110, and the communication properties are improved.

Tenth Embodiment

In a tenth embodiment, the plate portion includes protrusions arranged in a dot lattice.

Figure 12A:
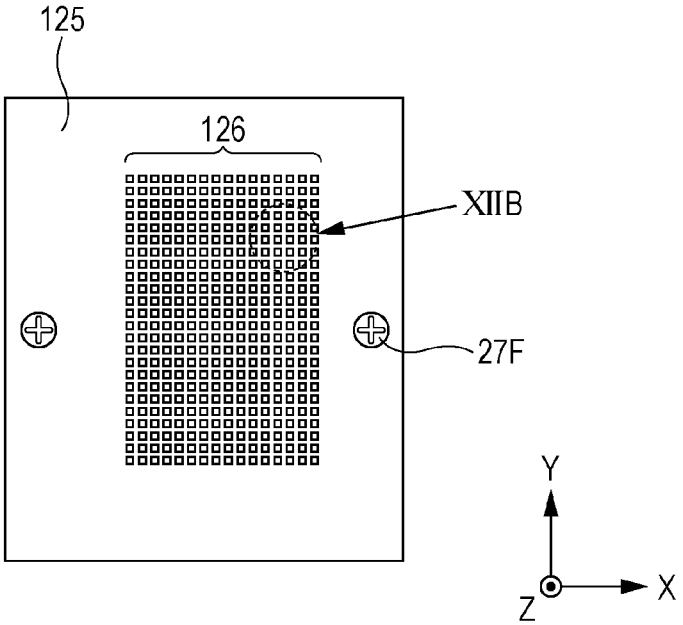
FIG. 12A is a top plan view of a plate portion and illustrates a configuration example of the plate portion in a tenth embodiment.
Figure 12B:
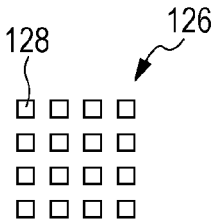
FIG. 12B is an enlarged view of a part including concave portions and convex portions and which illustrates a configuration example of the plate portion in the tenth embodiment.

FIG. 12A and FIG. 12B illustrate a configuration example of a plate portion 125 in the tenth embodiment. FIG. 12A is a top plan view of the plate portion 125.

As in the eighth embodiment, the plate portion 125 has a plate-like shape. The surface of the plate portion 125 includes a rough section 126. The rough section 126 includes columnar projections 128 arranged in a dot lattice. In the rough section 126, convex portions and concave portions are alternately arranged in the X direction and the Y direction.

FIG. 12B is an enlarged view of a part of the rough section 126, which is encircled by a broken line XIIB in FIG. 12A. The projections 128 each have a cubic shape, for example. The projection 128 has a height of about λ/4 in the Z direction, for example. A distance between adjacent projections 128, i.e., the width of the convex portion, is about λ/10 or more, for example, to allow signals to readily enter.

Since the projections 128 are arranged in the dot lattice, the radio wave readily reaches the plate portion 125 while being less influenced by the polarization direction of the radio signal traveling to the plate portion 125, compared with projections arranged in lines. Thus, the signal traveling to the plate portion 125 and the signal traveling from the plate portion 125 cancel each other out. Undesirable signals are readily eliminated.

The projection 128 may have any shape other than the cubic shape. Examples of the shapes include a polygonal prism shape such as a triangular prism shape and a hexagonal prism shape, a cylindrical columnar shape, and an elliptical columnar shape. Such a shape can provide the same advantages.

Eleventh Embodiment

In an eleventh embodiment, every projection is angled at 45 degrees in the X-Y plane compared with the position in the tenth embodiment.

Figure 13A:
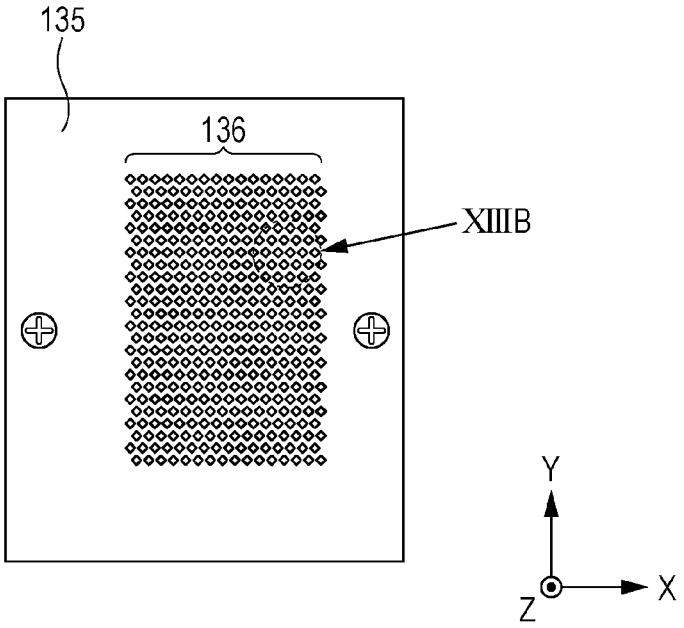
FIG. 13A is a top plan view of a plate portion and illustrates a configuration example of the plate portion in an eleventh embodiment.
Figure 13B:
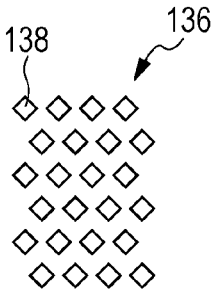
FIG. 13B is an enlarged view of a part including concave portions and convex portions and illustrates a configuration example of the plate portion in the eleventh embodiment.

FIG. 13A and FIG. 13B are schematic views illustrating a configuration example of a plate portion 135 in the eleventh embodiment. FIG. 13A is a top plan view of the plate portion 135. FIG. 13B is an enlarged view of a part of a rough section 136, which is encircled by a broken line XIIIB in FIG. 13A.

The surface of the plate portion 135 includes the rough section 136. In the rough section 136, columnar protrusions 138 are arranged in a dot lattice. The rough section 136 includes convex portions and concave portions alternately arranged in the X direction and the Y direction. Each of the convex portions and each of the concave portions are angled or inclined at 45 degrees, for example, with respect to the X direction and the Y direction.

As in the tenth embodiment, the projections 138 each have a cubic shape, for example. The projection 138 has a height of about λ/4, for example. A distance between adjacent projections 138, i.e., the width of the convex portion, is about λ/10 or more, for example, to allow signals to readily enter therebetween.

Since the projections 138 are inclined at 45 degrees to the direction of the columns, the radio wave readily reaches the plate portion 125 while being less influenced by the polarization direction of the radio signal traveling to the plate portion 125. Thus, the signal traveling to the plate portion 125 and the signal traveling from the plate portion 125 cancel each other out. Undesirable signals are readily eliminated.

The projection 138 may have any shape other than the cubic shape. Examples of the shapes include a polygonal prism shape such as a triangular prism shape and a hexagonal prism shape, a cylindrical columnar shape, and an elliptical columnar shape. Such a shape can provide the same advantages.

Although the convex portions and the concave portions are angled at 45 degrees in the X direction and the Y direction, for example, the convex portions and the concave portions may be angled at any degree other than 45 degrees.

Various embodiments have been described with reference to the drawings. However, the present disclosure is not limited to the examples described above. A person skilled in the art may readily achieve modifications or corrections within the scope of the above-described embodiments. It is to be understood that those modifications and corrections are within the technical scope of the present disclosure.

In the above-described embodiments, the wireless units on the sending side and the receiving side include the protrusions having the same configuration. However, the wireless units may include protrusions having different configurations. Alternatively, only one of the wireless units may include the protrusion and the other one of the wireless units may not include the protrusion. The protrusion may have any shape that enables the signal transmitted from one of the wireless units to reach the other one of the wireless units on the receiving side without being interfered with the reflected signal reflected between the wireless units, which face each other, for example.

In the above-described embodiments, the protrusion extends from the lid 12B so as to have a spherical surface or a slope shape. With this configuration, the direction of the signal that has been transmitted to and reflected by the protrusion is changed. In addition, in the above-described embodiment, the surface of the plate portion includes the projections. With this configuration, the signal traveling to the plate portion and the signal traveling from the plate portion cancel each other out. The chassis may have a surface that can have both of the above-described advantages. The protrusion may have projections on the surface thereof, for example. With this configuration, the protrusion reflect the signals and the signal traveling to the protrusion and the signal traveling from the protrusion cancel each other out. This configuration may have a joint effect between the reflection and the cancelling out.

In the above-described embodiments, the explanation has been given mainly to the case where the reflected signal reflected by one of the wireless units interferes with the transmission signal transmitted from the one of the wireless units, and thus the other one of the wireless units that faces the one of the wireless unit has lower receiving properties. However, the application of the present disclosure should not be limited to such a case. The present disclosure is applicable to the case where the reflected signal reflected by one of the wireless units interferes with the receiving signal to be received by the one of the wireless units. In such a case, due to the technique disclosed in the present disclosure, the receiving properties of the one of the wireless units is unlikely to be deteriorated.

BRIEF DESCRIPTION OF ASPECTS OF THE PRESENT DISCLOSURE

A first wireless device of the present disclosure includes an antenna that has a planar shape and radiates a radio signal toward another wireless device facing the wireless device, and a chassis housing the antenna and having an outer peripheral portion placed to face the antenna. Multiple distances between a surface of the outer peripheral portion and the antenna are non-uniform.

In a second wireless device of the present disclosure according to the first wireless device, the outer peripheral portion may include a protrusion having a top portion that is farthest away from the antenna.

In a third wireless device of the present disclosure according to the second wireless device, the top portion of the protrusion may be positioned on a line extending through a central portion of the antenna in a direction perpendicular to the antenna.

In a fourth wireless device of the present disclosure according to the second wireless device, the top portion of the protrusion may be positioned away from a line extending through a central portion of the antenna in a direction perpendicular to the antenna.

In a fifth wireless device of the present disclosure according to any one of the second to fourth wireless devices, the protrusion may have a spherical outer surface having a predetermined curvature at a portion including the top portion.

In a sixth wireless device of the present disclosure according to any one of the second to fourth wireless devices, the protrusion may have a polygonal prism shape, and the top portion may be a lateral edge of the polygonal prism shape.

In a seventh wireless device of the present disclosure according to any one of the second to fourth wireless devices, the protrusion may have a polygonal pyramid shape, and the top portion may be an apex of the polygonal pyramid shape.

In an eighth wireless device of the present disclosure according to the first wireless device, the outer peripheral portion may include a plurality of projections each continuously extending in a predetermined direction.

In a ninth wireless device of the present disclosure according to the eighth wireless device, the projections each may have a triangular cross-sectional shape.

In a tenth wireless device of the present disclosure according to the first wireless device, the outer peripheral portion may include projections arranged in a dot lattice.

In an eleventh wireless device of the present disclosure according to any one of the eighth to tenth wireless devices, the projections each may have a height that is about one-fourth of a wavelength of the radio signal.

In a twelfth wireless device of the present disclosure according to any one of the eighth to tenth wireless device, a distance between adjacent projections may be about one-tenth or more of a wavelength of the radio signal.

A wireless system of the present disclosure includes a first wireless device and a second wireless device facing the first wireless device to communicate with the first wireless device. The first wireless device includes an antenna that has a planar shape and radiates a radio signal toward the second wireless device, and a chassis housing the antenna and having an outer peripheral portion placed to face the antenna. Multiple distances between the antenna and a surface of the outer peripheral portion are non-uniform.

The present disclosure is advantageously applied to a wireless device and a wireless system, for example, to reduce the interference of the reflected signal with the communication signal and provide improved communication properties.

What is claimed is:

1. A wireless device comprising:

an antenna having a planar shape and which, in operation, radiates a radio signal; and a chassis having an outer peripheral portion and housing the antenna with a first side of the outer peripheral portion facing the antenna, a second side of the outer peripheral portion opposite from the first side including a plurality of projections each having a height that is about one-fourth of a wavelength of the radio signal, wherein multiple non-uniform distances are formed between a surface of the second side of the outer peripheral portion and the antenna along a direction perpendicular to the planar shape of the antenna.

2. The wireless device according to claim 1, wherein the projections each have a triangular cross-sectional shape.

3. The wireless device according to claim 1, wherein the projections are arranged in a line.

4. The wireless device according to claim 1, wherein the projections are arranged in a dot lattice.

5. The wireless device according to claim 1, wherein a distance between adjacent projections is about one-tenth or more of a wavelength of the radio signal.

6. A wireless device comprising:

an antenna having a planar shape and which, in operation, radiates a radio signal; and a chassis having an outer peripheral portion and housing the antenna with a first side of the outer peripheral portion facing the antenna, a second side of the outer peripheral portion opposite from the first side including a plurality of projections separated by a distance that is about one-tenth or more of a wavelength of the radio signal, wherein multiple non-uniform distances are formed between a surface of the second side of the outer peripheral portion and the antenna along a direction perpendicular to the planar shape of the antenna.

7. The wireless device according to claim 6, wherein the projections each have a triangular cross-sectional shape.

8. The wireless device according to claim 6, wherein the projections are arranged in a line.

9. The wireless device according to claim 6, wherein the projections are arranged in a dot lattice.

* * * * *